US006058711A

United States Patent [19]

Maciaszek et al.

[11] Patent Number: 6,058,711

[45] Date of Patent: May 9, 2000

[54] CAPILLARY EVAPORATOR FOR DIPHASIC LOOP OF ENERGY TRANSFER BETWEEN A HOT SOURCE AND A COLD SOURCE

[75] Inventors: Thierry Maciaszek, Montbrun-Lauragais; Jacques Mauduyt, Auzeville, both of France

[73] Assignee: Centre National d'Etudes Spatiales, Paris, France

[21] Appl. No.: 09/058,516

[22] Filed: Apr. 10, 1998

Related U.S. Application Data

[63] Continuation of application No. PCT/FR97/01470, Aug. 8, 1997.

[30] Foreign Application Priority Data

Aug. 12, 1996 [FR] France ..... 9610110

[51] Int. Cl.[7] ..... F25B 21/02

[52] U.S. Cl. ..... 62/3.2; 62/3.7; 62/512; 62/318; 62/474; 62/515; 62/527; 165/104.26

[58] Field of Search ..... 62/3.2, 3.7, 512, 62/318, 474, 515, 527; 165/124.26

[56] References Cited

U.S. PATENT DOCUMENTS

| | | | |
|---|---|---|---|
| 4,352,392 | 10/1982 | Eastman | 165/104.25 |
| 4,467,861 | 8/1984 | Kiseev et al. | 165/104.22 |
| 4,748,826 | 6/1988 | Laumen | 62/268 |
| 4,791,634 | 12/1988 | Miyake | 374/34 |
| 4,869,313 | 9/1989 | Fredley | 165/41 |
| 4,934,160 | 6/1990 | Mueller | 62/515 |
| 4,957,157 | 9/1990 | Dowdy et al. | 165/104.27 |
| 5,725,049 | 3/1998 | Swanson et al. | 165/104.26 |
| 5,842,513 | 12/1998 | Mciaszek et al. | 165/104.26 |

FOREIGN PATENT DOCUMENTS

| | | |
|---|---|---|
| 0 210 337 | 2/1996 | European Pat. Off. . |
| WO96/04517 | 2/1987 | WIPO . |

*Primary Examiner*—Henry Bennett
*Assistant Examiner*—Mark Shulman
*Attorney, Agent, or Firm*—Jacobson, Price, Holman & Stern PLLC

[57] ABSTRACT

The evaporator comprises a) a chamber (12) made of a porous material with an inlet for a heat exchanging fluid in liquid form, b) a shell (9) in which is located said chamber (12) to define around it, a chamber (15) for collecting said fluid in vapor form, said shell (9) having an outlet by which the vapor collected in said chamber (15) is evacuated. It further comprises a tube (22) which extends through the whole internal space of the chamber (12) with a porous wall, from one end (24) of the tube constituting the chamber (12) inlet for the heat exchanging fluid, said tube (22) being pierced over its whole length with holes (33) for injecting the heat exchanging liquid into the chamber (12) wall.

9 Claims, 2 Drawing Sheets

CAPILLARY EVAPORATOR FOR DIPHASIC LOOP OF ENERGY TRANSFER BETWEEN A HOT SOURCE AND A COLD SOURCE

This application is a continuation of International Patent application No. PCT/FR97/01470 filed on Aug. 8, 1997 and claiming the priority of French Patent application No. 96 10110 filed on Aug. 12, 1996.

BACKGROUND OF THE INVENTION

The present invention concerns a capillary evaporator for a two-phase loop for transferring energy between a hot source and a cold source, of the type that includes a) a porous material enclosure having an inlet for a heat-conducting fluid in the liquid state, and b) a jacket in which said enclosure is placed to define around the latter a chamber for collecting said fluid in the vapor state, said jacket having an outlet via which the vapor collected by said chamber is removed.

An evaporator of the above kind is known from French patent application No. 94 09459 filed Jul. 29, 1994 by the applicant. Evaporators of the above kind are part of two-phase loops such as that shown in FIG. 1 of the appended drawings, which is used to transfer thermal energy from a "hot source" area A to a "cold source" area B at a lower temperature. The loop takes the form of a closed circuit in which flows a heat-conducting fluid that can be water, ammonia, "Freon", etc, depending on the working temperatures. The circuit includes "capillary" evaporators 1, 1', . . . connected in parallel, condensers 2 also connected in parallel (or in series-parallel), a vapor flow pipe 3 and a liquid flow pipe 4. The direction of flow of the fluid is indicated by the arrows 5. An isolator 6 can be placed at the entry of each evaporator to prevent accidental return flow of vapor into the pipe 4. A supercooler 7 is placed on the pipe 4 to condense any vapor that is inadvertently not totally condensed at the outlet from the set of condensers 2 and to lower the temperature as a safety measure against the temperature locally reaching the saturation temperature leading to generation of bubbles of vapor on the upstream side of the evaporators.

The working temperature of the loop is controlled by a two-phase pressurizer storage container 8 mounted on the pipe 4. This storage container is controlled thermally (by means that are not shown) to control the evaporation temperature.

With this type of loop it is possible in most cases to control the set point temperature for the hot source A to an accuracy better than 1°, regardless of the power variations that the loop undergoes at the evaporators or condensers. The hot source can be equipment generating heat and installed on a spacecraft or on the ground, for example, the loop maintaining the temperature of the equipment at a value compatible with its correct operation.

The maximal power that can be conveyed is conditioned by the maximum pressure rise that the capillary evaporators can produce and by the total head losses of the circuit for the maximal power in question. As described in the aforementioned French patent application, with ammonia pressure rises in the order of 5000 Pa can be achieved.

FIGS. 2 and 3 show an evaporator 1 suitable for use in the loop from FIG. 1. It is described in the document "Capillary pumped loop technology development" by J. Kroliczek and R. McIntosh, ICES conference, LONG BEACH (Calif.), 1987. Evaporators of the above type are sold by the American company OAO.

The evaporator 1 includes a metal tubular jacket 9 that is a good conductor of heat with an inlet 10 at one end and an outlet 11 at the opposite end. A cylindrical enclosure 12 with porous material walls is held coaxially inside the jacket 9 by spacers 13 (see FIG. 3).

The porous material, known as the "capillary wick", can be any material having substantially homogeneous pores of appropriate size, for example sintered metallic or plastics (polyethylene) or ceramic materials.

As explained in the aforementioned French patent application, to which reference should be had for more detailed information, in normal operation the space 14 inside the enclosure 12 is filled with the heat-conducting fluid in the liquid state and the annular chamber 15 collects the vapor of this liquid which forms in the chamber due to the effect of the heat generated by the hot source A. The pressure of the vapor is higher than the pressure of the liquid, which enables flow of the heat-conducting fluid in the loop and removal of the heat conveyed towards the cold source B. The power of the installation is increased by disposing a plurality of evaporators in parallel, as shown in FIG. 1.

However, the heat-conducting fluid that flows in the loop is virtually never pure and often contains gases that cannot be condensed in the loop, such as hydrogen. This gas can result from decomposition of the heat-conducting fluid when the latter is ammonia, for example. It can also result from chemical reactions between the ammonia and metallic parts of the loop made of aluminum, for example. In conditions of very low gravity, this incondensible gas can collect in a pocket 16 at the bottom of the enclosure 12, as shown in FIG. 2.

The space 14 inside the enclosure 12 can also contain bubbles 17 of uncondensed vapor of the heat-conducting fluid. This can cause local blocking of the flow of this fluid and therefore thermal runaway of the loop. If a portion of the capillary material constituting the wall of the enclosure 12, subject to the heat flow from the hot source A, is no longer directly supplied with the liquid from the interior of the enclosure, because of a pocket 16 of uncondensed or incondensible vapor or gas, the liquid contained in this portion of the capillary material evaporates quickly. A "punch-through" 18 appears in the enclosure 12 and the pressurized vapor then instantaneously fills the space 14 inside the enclosure 12, which blocks the flow of the heat-conducting fluid.

FIG. 4 is a schematic representation of a different type of evaporator, as described in the document "Method of increase the evaporation reliability for loop heat pipes and capillary pumped loops" by E. Yu. Kotliarov, G. P. Serov, ICES conference, Colorado Springs, USA, 1994. Evaporators of the above type are sold by the Russian company Lavotchkin.

In FIG. 4 and subsequent figures of the appended drawings reference numbers identical to references used in FIGS. 1 through 3 indicate members or units that are identical or similar.

The FIG. 4 evaporator differs from that of FIGS. 2 and 3 in that it incorporates a buffer storage container 19 at the entry of the evaporator proper, which includes a jacket 9 and a porous material enclosure 12 similar to those of the evaporator from FIG. 2. The evaporator further includes a solid wall tube 20 passing axially through the pressurizer storage container 19 and the enclosure 12, this tube discharging at a point near the bottom of the enclosure.

If the heat-conducting fluid arriving via the inlet 10 of the tube contains incondensible bubbles 17 of gas or 17' of vapor, the bubbles pass through the tube 20 and return "countercurrentwise" into the storage container 19 without disrupting the operation of the porous wall of the enclosure 12, which is then not subject to any loss of priming.

On the other hand, because the evaporator from FIG. 4 incorporates its own pressurizer storage container 19, it becomes virtually impossible to dispose a plurality of such parallel evaporators in a loop like that of FIG. 1, any pressure imbalance between two reservoirs emptying one to fill the other. Because of this the power that can be conveyed by the loop remains limited.

FIG. 5 is a schematic representation of another type of evaporator as described in the document "Test results of reliable and very high capillary multi-evaporation condensers loops" by S. Van Ost, M. Dubois and G. Beckaert, ICES conference, San Diego, Calif., USA, 1995. Evaporators of the above type are sold by the Belgian company SABCA.

The evaporator is placed in one branch of a circuit that includes one evaporator per branch, a common pressurizer storage container 8 feeding all the branches. Like the previous ones, the evaporator includes a jacket 9 and a porous wall enclosure 12. The reservoir 8 and the evaporator are connected by a tubular pipe lined with a "capillary coupling" 21 consisting of a woven metal tube. In normal operation the heat-conducting liquid reaching the condenser 2 passes through the pressurizer storage container 8 and fills all of the pipe 3 and the space inside the enclosure 12.

With incondensible gas in the loop but with no generation of vapor in the heart of the evaporator, a situation characteristic of operation at high thermal power (typically greater than 50 W for ammonia), the incondensible gas accumulates in the enclosure 12 of the evaporator inside the capillary coupling 21 only. The porous material of the enclosure 12 then continues to be supplied with the heat-conducting liquid, which assures operation of the evaporator.

In the presence of incondensible gas and with generation of vapor in the enclosure 12, a situation characteristic of operation at low thermal power, the vapor that forms in the enclosure can, if the generating pressure is sufficiently high, return into the pressurizer storage container 8, as shown diagrammatically in FIG. 5, and entrain the incondensible gas. The liquid flows at the periphery of the capillary coupling 21 and feeds the porous material of the enclosure, which assures the operation of the evaporator.

It is then possible to place a plurality of evaporators in parallel and the resulting loop is highly resistant to the presence of incondensible gas or vapor in the porous enclosure 12 of the evaporators.

On the other hand, the capillary coupling 21 present in the evaporator feed pipes 3 make the latter rigid and bulky (diameter in the order of 10 mm), drawbacks which can become unacceptable when the loop must be disposed in a restricted space of complex shape, as is often the case in spacecraft, for example.

SUMMARY OF THE INVENTION

An aim of the present invention is therefore to provide an evaporator for a capillary pumped two-phase loop that tolerates the presence of incondensible vapor or gas inside its porous enclosure.

Another aim of the present invention is to provide an evaporator of this kind adapted to be integrated into a two-phase loop containing a plurality of such evaporators connected in parallel, the geometry of the loop being adaptable for installation in a space that is small and/or of complex shape.

These aims of the invention, and others that will become apparent on reading the following description, are achieved with an evaporator of the type described in the preamble to this description that is remarkable in that it includes a tube that extends throughout the space inside the porous wall enclosure from one end of the tube constituting the heat-conducting liquid inlet of the enclosure, said tube having throughout its length holes for injecting the heat-conducting liquid into the wall of the enclosure.

As described in more detail below, in all circumstances this tube feeds all of the porous wall enclosure with heat-conducting liquid, which assures the necessary generation of vapor by the evaporator, even in the presence of uncondensed or incondensible vapor or gas in said enclosure.

BRIEF DESCRIPTION OF THE DRAWINGS

Other features and advantages of the present invention will become apparent from a reading of the following description and an examination of the appended drawings, in which.

DESCRIPTION OF PREFERRED EMBODIMENTS

Figure 1:
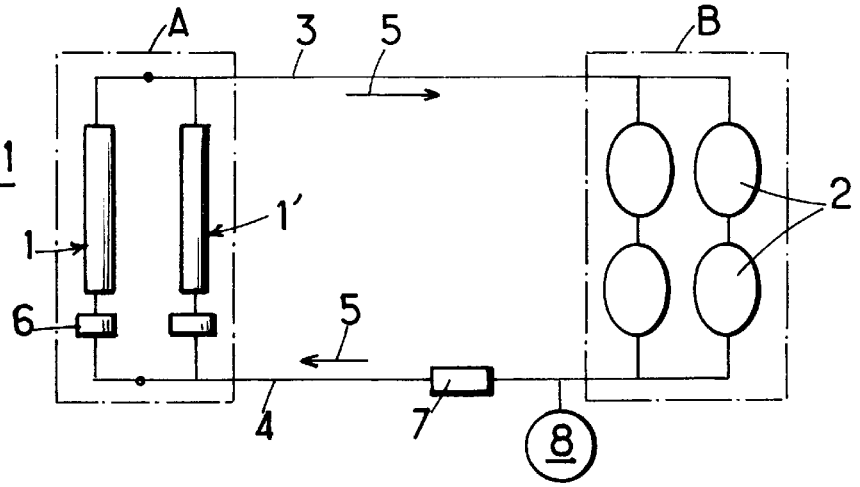
FIG. 1 is a schematic representation of a two-phase energy transfer loop comprising capillary evaporators described in the preamble to this description.
Figure 6:
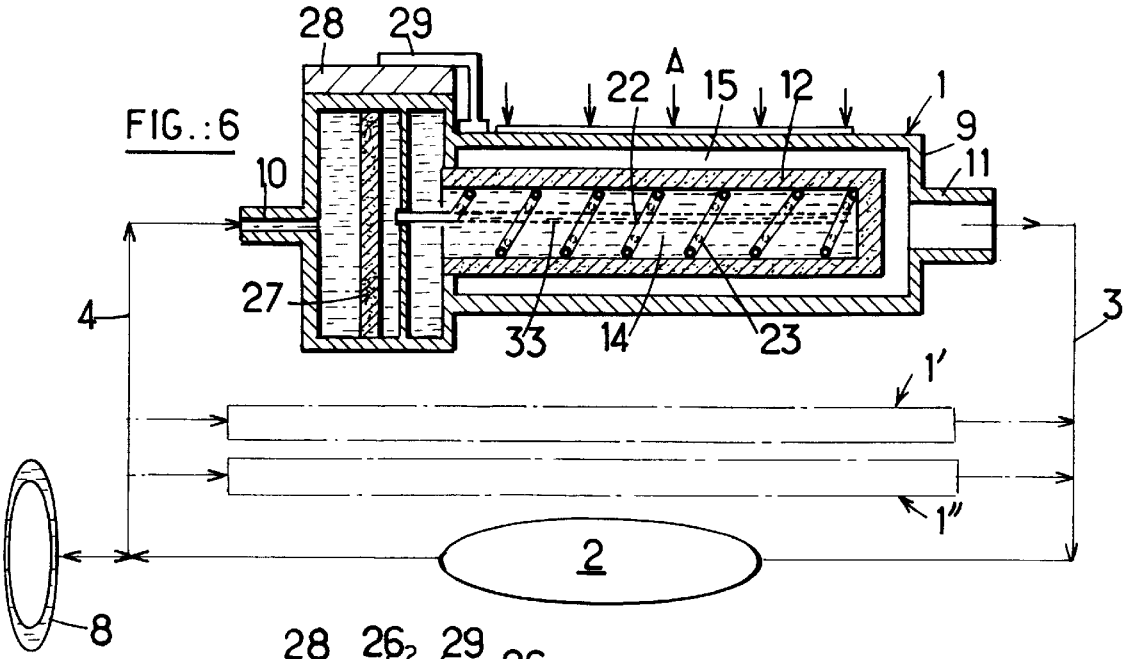
FIG. 6 is a diagrammatic representation of a two-phase loop including at least one capillary evaporator in accordance with the present invention (shown in axial section)

FIG. 6 of the appended drawings repeats the essential parts of the two-phase loop from FIG. 1, namely, in addition to one or more capillary evaporators 1, 1', 1", . . . of the invention, gas and vapor pipes 3, 4, a condenser 2 and a pressurizer storage container 8.

Figure 3:
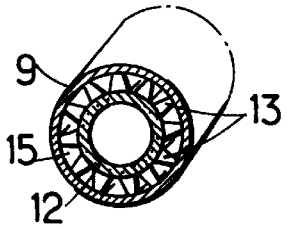
FIG.:3 (PRIOR ART)

The evaporator of the invention comprises, like the previous ones, a tubular jacket 9 and a porous wall enclosure 12 supported in the jacket 9 and spaced from the jacket by spacers such as the spacers 13 shown in FIG. 3 or by grooves formed on the inside face of the jacket 9, so as to define between the jacket and the enclosure a chamber 15 for collecting the vapor formed in the evaporator. The evaporator includes an inlet 10 for the heat-conducting fluid in the liquid state and an outlet 11 for the vapor of this fluid.

In accordance with one feature of the evaporator of the invention, the evaporator includes (see FIG. 6) a tube 22, of helical shape, for example, extending axially throughout the interior space of the enclosure 12, as far as the bottom of the latter. The tube 22 is closed at its end 22' near the bottom but has holes 23 in it throughout its length, for example regularly spaced holes. The helical tube 22 is a substantial fit to the inside diameter of the enclosure 12 so that it closely follows the porous wall of the enclosure. The holes 23 face this wall so that heat-conducting liquid injected into the space 14 inside the enclosure 12 sprays this wall continuously, as explained below.

The open end 24 of the tube 22 passes through and is supported by an impermeable material partition 25 mounted transversely in a chamber 26 interposed in accordance with the invention between the inlet 10 of the evaporator and the combination of the jacket 9 and the enclosure 12. The partition 25 divides the chamber 26 into a first compartment ($26_1$, $26_2$), see FIG. 7, and a second compartment $26_3$ one of which ($26_1$, $26_2$) contains a partition 27 of a porous material similar to that constituting the wall of the enclosure 12. The partition 27 is transverse to the axis X of the evaporator and is therefore substantially parallel to the impermeable partition 26. It divides the first compartment ($26_1$, $26_2$) into two sub-compartments $26_1$ and $26_2$.

In accordance with another feature of the present invention, means 28 for cooling the chamber 26 are mounted on the latter. As described below, the means 28 are used to condense the heat-conducting fluid in the vapor state present in the chamber 26 in some modes of operation of the evaporator. To give an illustrative and non-limiting example, the means 28 can be a Peltier effect cold source. In this case a heat sink 29 can be disposed between the means 28 and the metal jacket 9.

The evaporator of the invention then operates as follows.

In the absence of incondensible gas and vapor in the enclosure or at the inlet of the evaporator, an ideal situation shown in FIG. 6, the heat-conducting liquid returning from the condenser 2 passes through the porous partition 27 and is then obliged to enter the perforated tube 22 extending into the heart of the evaporator. The liquid sprays out of the holes 23 in the tube, injecting the heat-conducting liquid into the porous wall of the enclosure facing the holes. The enclosure 12 of the evaporator is full of liquid and its porous wall is always supplied with liquid. The condenser means 28 are then of no utility and therefore inactive. The evaporator operates normally.

Figure 7:
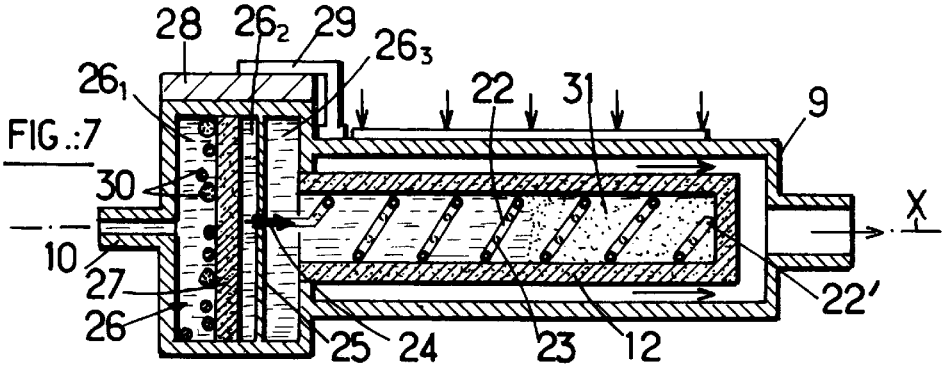
FIGS. 7 through 9 are diagrammatic representations of the capillary evaporator of the invention similar to that of FIG. 6 and used to describe how it works.

The operation of the evaporator in accordance with the invention with incondensible gas bubbles 30 in the loop and with no vapor formed in the enclosure 12 will now be explained with reference to FIG. 7. This situation arises in high power operation of the evaporator (typically greater than 50 W for ammonia). In this case the incondensible gas bubbles 30 are stopped by the porous partition 27 at the inlet of the evaporator, as shown in the figure. However, in conditions of very low gravity, for example, a quantity of incondensible gas can accumulate in a portion 31 of the enclosure 12 by desorption of the gas dissolved in the liquid. Nevertheless, because of the perforated tube 22, the porous wall of the enclosure 12 continues to be wetted by the liquid, even in this portion 31 of the enclosure in which the incondensible gas has accumulated. In this case the cold source 28 can remain inactive and the performance of the evaporator remains nominal.

Figure 8:
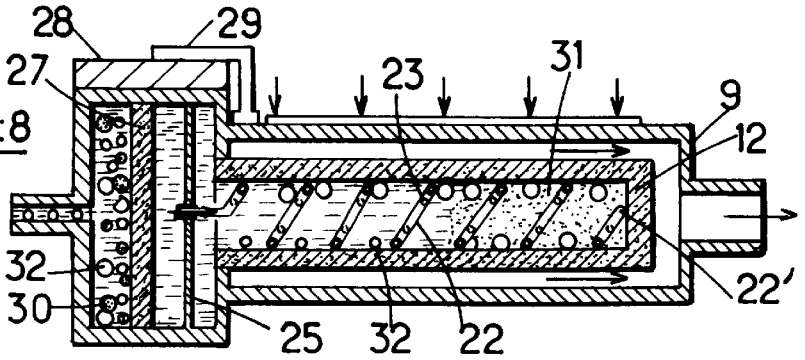

The operation of the evaporator of the invention with incondensible gas bubbles 30 in the loop and with formation of vapor bubbles 32 in the enclosure 12 will now be described with reference to FIG. 8. This situation arises in operation at low thermal power (typically less than 50 W for ammonia). In this case the porous partition 27 stops the incondensible gas 30 and the vapor 32 that enter the evaporator due to the effect of the flow of heat-conducting fluid. A quantity of incondensible gas can nevertheless accumulate at 31 in the enclosure 12 as in the previous situation and the enclosure is assumed to contain also the vapor 32 that forms therein, assumed to be in small quantities. Nevertheless, because of the perforated tube 22, the porous wall of the enclosure 12 continues to be wetted by the heat-conducting liquid, even in the portion 31 in which the incondensible gas and the vapor has accumulated. To prevent the vapor accumulating on the upstream side of the porous partition 27 covering all of the surface of the partition and so preventing operation of the evaporator, the invention activates the Peltier effect cold source 28 to condense this vapor. Its cooling capacity must evidently be compatible with the power (which is nevertheless very low) needed to condense the total mass flowrate of vapor generated in the enclosure 12 of the evaporator and reaching the inlet of the latter. The typical cooling capacity required for an ammonia evaporator is in the order of a few watts, for example.

Figure 9:
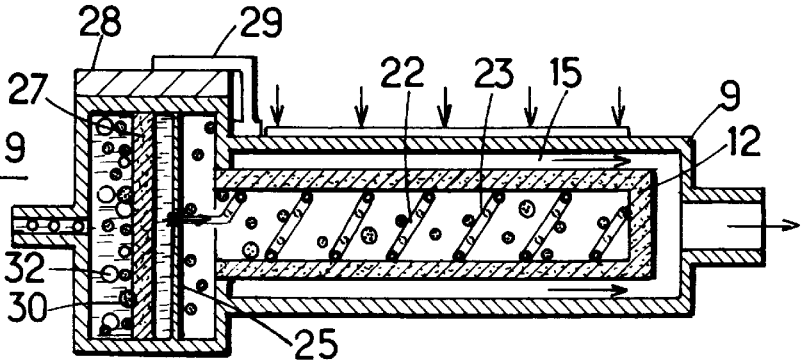

FIG. 9 is a schematic representation of extreme operation of the evaporator of the invention when the enclosure 12 is filled with incondensible gas and vapor, only the perforated tube 22 remaining filled with the heat-conducting liquid for spraying onto the inside face of the porous wall of the enclosure 12, to assure operation of the evaporator. In this extreme case the power delivered by the cold source 28 is exactly equal to that needed to condense all of the uncondensed vapor impinging on the porous partition 27.

Figure 2:
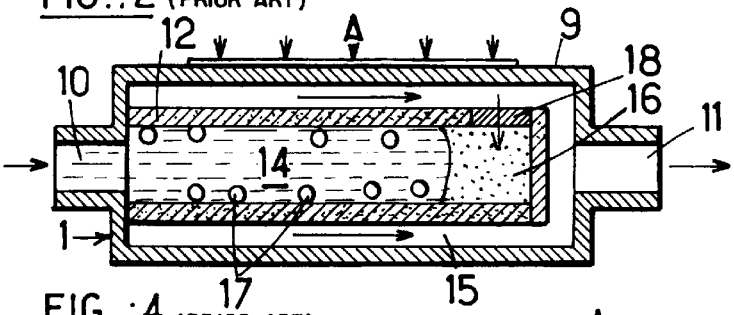
FIG.:2 (PRIOR ART)
FIGS. 2 through 5 represent prior art capillary evaporators also described in the preamble to this description.
Figure 4:
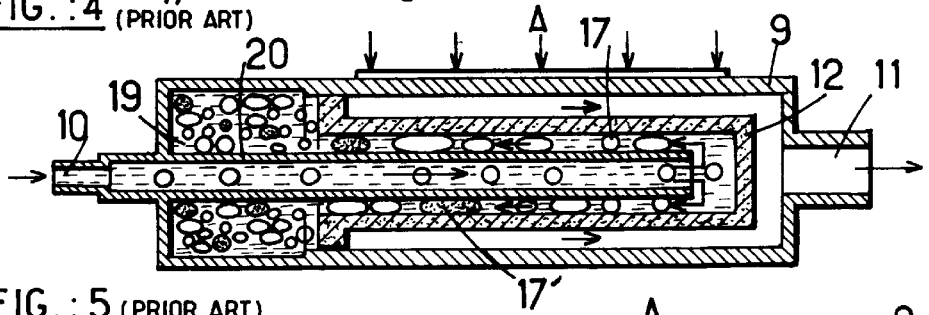
FIG.:4 (PRIOR ART)
Figure 5:
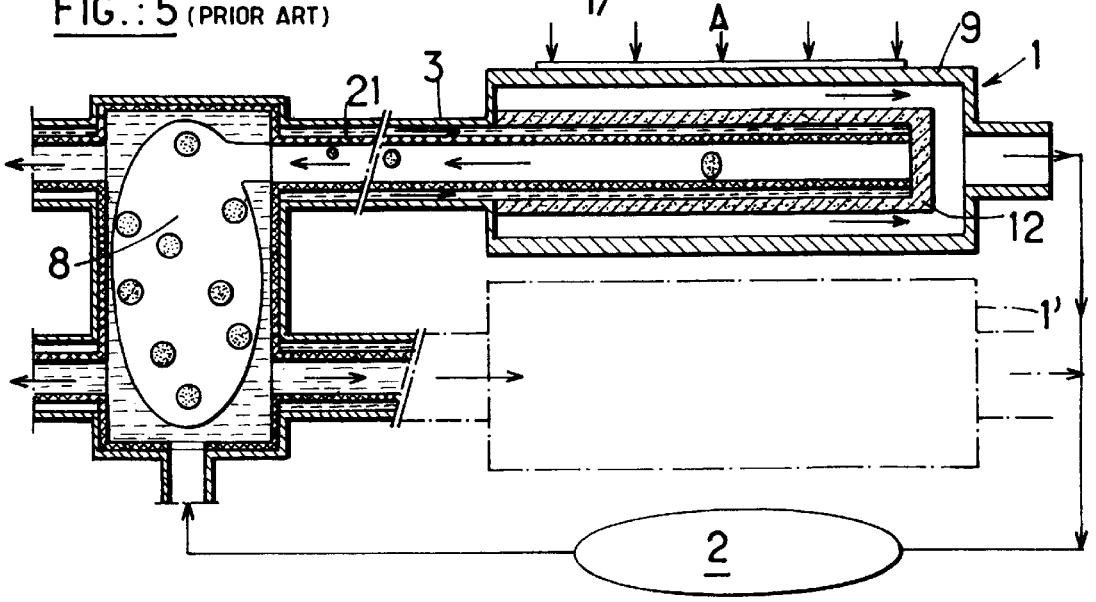
FIG.:5 (PRIOR ART)

It is now apparent that the invention achieves the stated objectives, namely providing an evaporator that can be disposed in parallel with others in a two-phase thermal energy transfer loop, unlike the prior art evaporator shown in FIG. 4. The evaporator of the invention is furthermore robust in the sense of tolerating generation of incondensible gas and vapor in the porous wall enclosure of the evaporator, unlike the evaporator shown in FIGS. 2 and 3. The connection of its inlet to a two-phase loop requires a simple flexible and non-rigid pipe, unlike the prior art evaporator shown in FIG. 5, which facilitates the integration of a loop of this kind into spaces that are small and/or of complex shape, as encountered in equipment of spacecraft.

Of course, the invention is not limited to the embodiments described and shown which have been given by way of example only. Thus the invention is not limited to applications in the thermal conditioning circuits of equipment for spacecraft and has applications in equipment operating on the ground. Further, the evaporator of the invention can be integrated into any type of capillary pumped two-phase loop, regardless of the level of the temperature to be regulated.

Equally, the evaporator of the invention can be modified to facilitate testing it on the ground. Under these conditions, if the evaporator is disposed vertically with its outlet at the top, gravity causes the liquid to collect at the bottom and the gas to collect at the top, both in the enclosure 12 and in the tube 22, the upper end of which is no longer supplied with heat-conducting liquid, the latter then no longer spraying the upper part of the enclosure 12. To avoid this problem, a straight solid wall tube 33 can be placed in the enclosure 12 (as shown in chain-dotted outline in FIG. 6) to allow the liquid entering the enclosure to enter the helical tube through the end of the tube near the bottom of the enclosure. In this case, it is evidently the other end of the tube 22, near the partition 25, that is closed. Thus the heat-conducting liquid entering the tube 22 sprays the wall of the enclosure, including any pocket of incondensible gas such as that shown at 31 in FIG. 7.

What is claimed is:

1. A capillary evaporator for two-phase loops for transferring energy between a hot source and a cold source of the type that includes a) a porous material enclosure having an inlet for a heat-conducting fluid in the liquid state and b) a jacket in which said enclosure is placed to define, around the latter, a chamber for collecting said fluid in the vapor state, said jacket having an outlet through which the vapor collected by said chamber is removed, said evaporator further comprising a tube that extends throughout the space inside the porous wall enclosure from one end of the tube constituting the heat-conducting liquid inlet of the enclosure, said tube having throughout its length holes for injecting the heat-conducting liquid into the wall of the enclosure.

2. An evaporator according to claim 1 further comprising a chamber at the inlet of the porous wall enclosure, the chamber being divided into first and second compartments by an impermeable material partition, the heat-conducting fluid entering the first compartment in the liquid state and entering the enclosure via the inlet of the perforated tube that passes through said partition and the second compartment.

3. An evaporator according to claim 2 wherein said first compartment is divided into first and second sub-compartments by a porous material partition substantially parallel to the impermeable material partition, the inlets of the first compartment and of the perforated tube being on respective opposite sides of said porous material partition.

4. An evaporator according to claim 3 further comprising means for condensing any vapor of the heat-conducting fluid present in the first sub-compartment.

5. An evaporator according to claim 3 wherein said condenser means are of the Peltier effect type.

6. An evaporator according to claim 5 further comprising a heat sink between said condenser means and the jacket of the evaporator, the jacket being made of a material that is a good conductor of heat.

7. An evaporator according to claim 1 wherein the perforated tube is helical in shape and is disposed near a cylindrical inside face of the porous wall of the enclosure, the holes in said tube discharging towards said wall and the end of the tube opposite its fluid inlet end being closed.

8. An evaporator according to claim 2 wherein the liquid entering the enclosure passes first through a solid wall tube connected at the other end to the perforated tube near the bottom of the enclosure.

9. In a two-phase loop for transferring energy between a hot source and a cold source, at least one capillary evaporator of the type that includes a) a porous material enclosure having an inlet for a heat-conducting fluid in the liquid state and b) a jacket in which said enclosure is placed to define, around the latter, a chamber for collecting said fluid in the vapor state, said jacket having an outlet through which the vapor collected by said chamber is removed, said evaporator further comprising a tube that extends throughout the space inside the porous wall enclosure from one end of the tube constituting the heat-conducting liquid inlet of the enclosure, said tube having throughout its length holes for injecting the heat-conducting liquid into the wall of the enclosure.

* * * * *